US005094376A

United States Patent [19]

Baruch

[11] Patent Number: 5,094,376

[45] Date of Patent: Mar. 10, 1992

[54] HOLSTER FOR AN AUTOMATIC WEAPON WITH INTERNAL RETENTION

[76] Inventor: Alan Baruch, 3119 Shannon Dr., Puntagorda, Fla. 33982

[21] Appl. No.: 697,322

[22] Filed: May 8, 1991

[51] Int. Cl.[5] ..... F41C 33/02

[52] U.S. Cl. ..... 224/243; 224/193; 224/244; 224/911

[58] Field of Search ..... 224/243, 244, 242, 193, 224/911, 912

[56] References Cited

U.S. PATENT DOCUMENTS

| | | | |
|---|---|---|---|
| 3,718,240 | 2/1973 | Rose | 224/243 |
| 4,101,060 | 7/1978 | Bianchi et al. | 224/243 |
| 4,485,948 | 12/1984 | Cook | 224/243 |

*Primary Examiner*—Linda J. Sholl
*Attorney, Agent, or Firm*—Blum Kaplan

[57] ABSTRACT

A holster for an automatic hand weapon and retention system which secures the weapon at the weapon's ejection port and trigger guard against unintentional withdrawal yet is made of lightweight, durable and inexpensive materials is provided. The holster is formed from a piece of fabric of synthetic material which is folded on itself and stitched to form a cavity for receiving the weapon. A first dowel is secured in a first pocket positioned above the muzzle end of the ejection port of the weapon. A second dowel is secured in a second pocket positioned in the trigger guard of the weapon. The first and second dowels engage the ejection port and trigger guard, respectively, of the weapon to prevent the removal of the weapon by an opponent or accidentally during strenuous activity by the user. Also provided is a holster suitable for wearing against a leg which has at least one dowel secured in a pocket positioned above the muzzle end of the ejection port of a weapon. An elastic strap secures the weapon in the holster and urges the ejection port towards the dowel, yet allows the user to rapidly remove the weapon.

5 Claims, 6 Drawing Sheets

FIG. 1
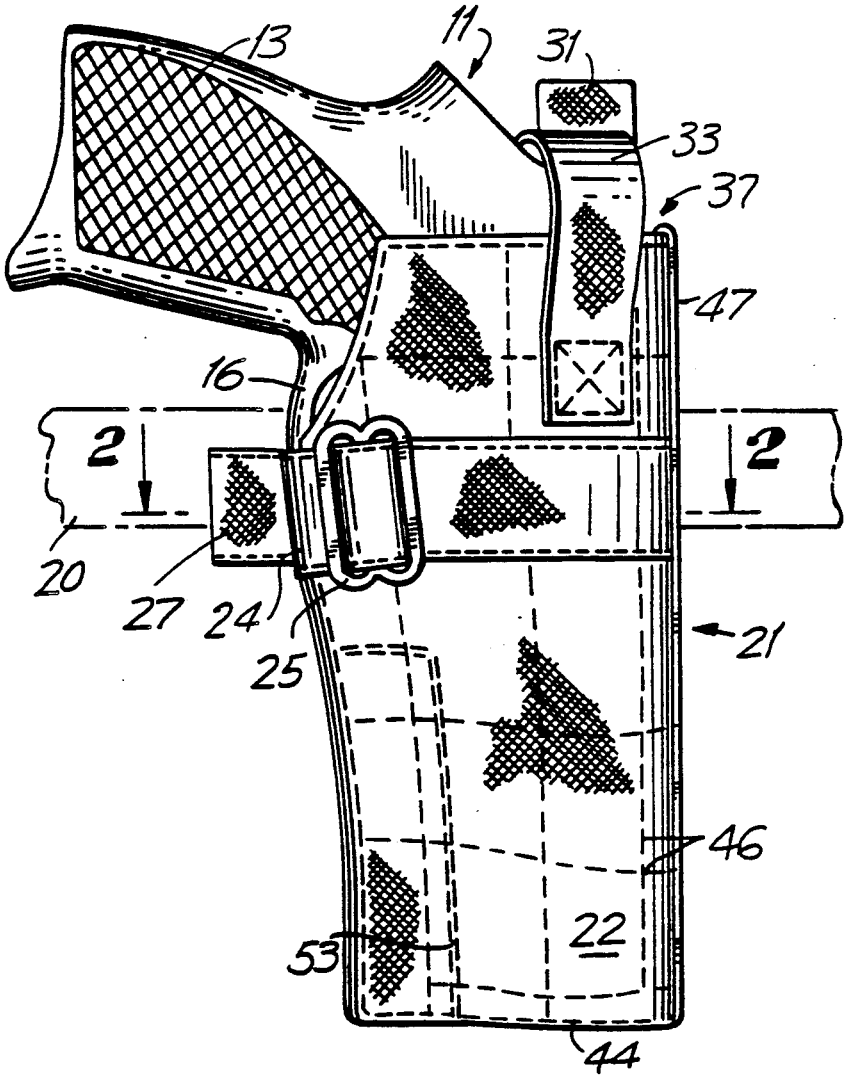
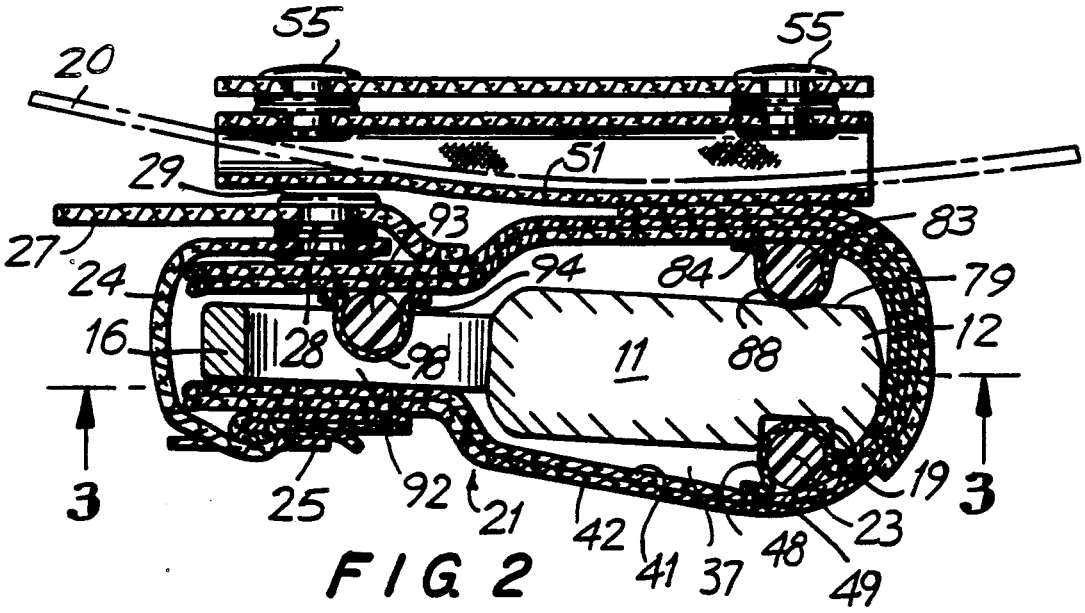
FIG. 2

FIG. 4
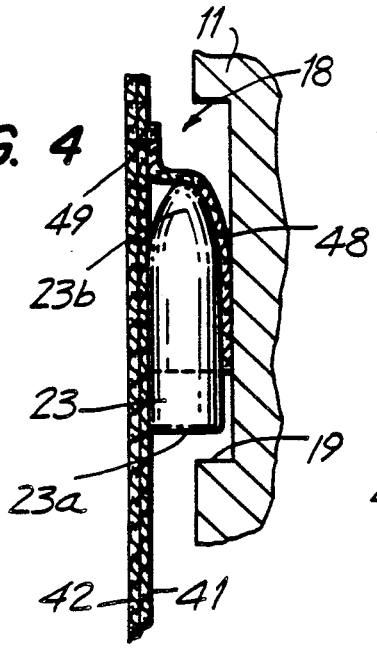
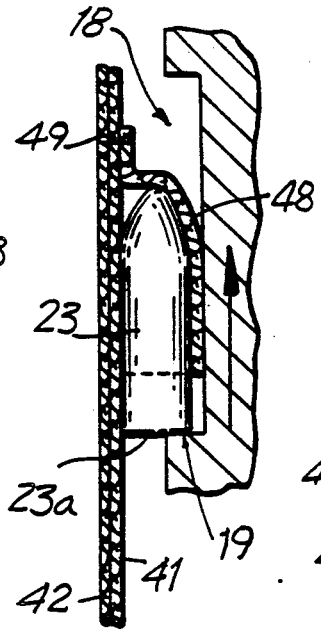
FIG. 5
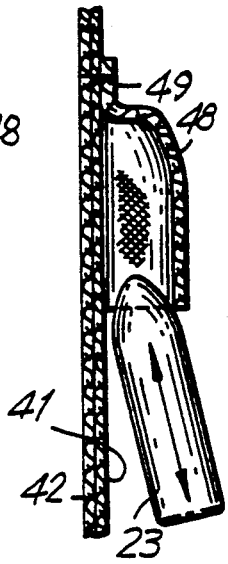
FIG. 6
FIG. 7
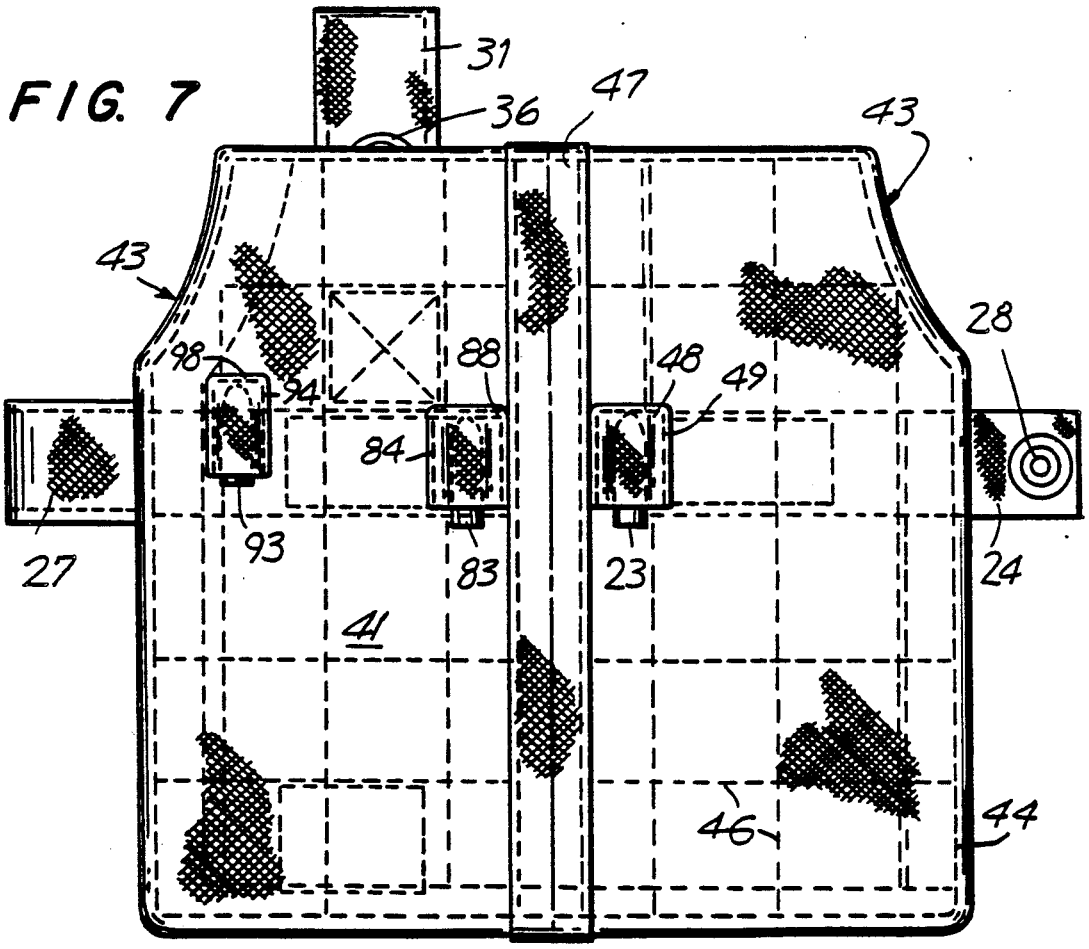

FIG. 8
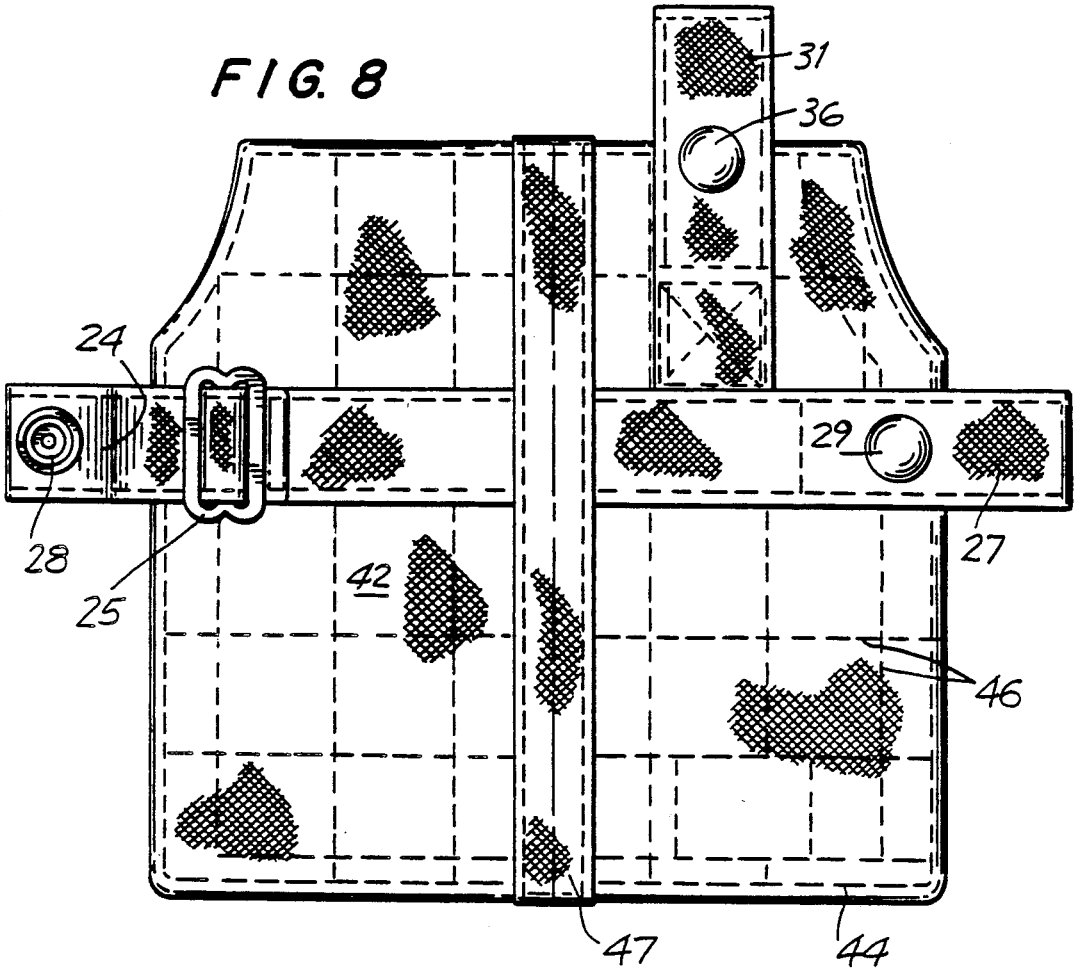
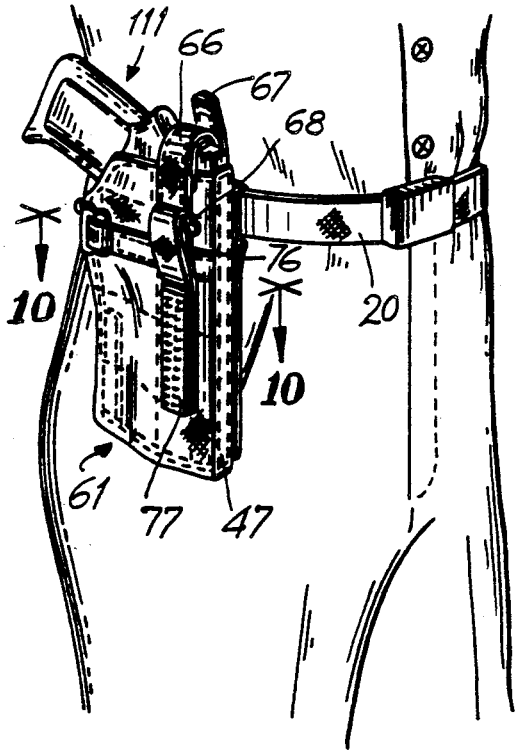
FIG. 9

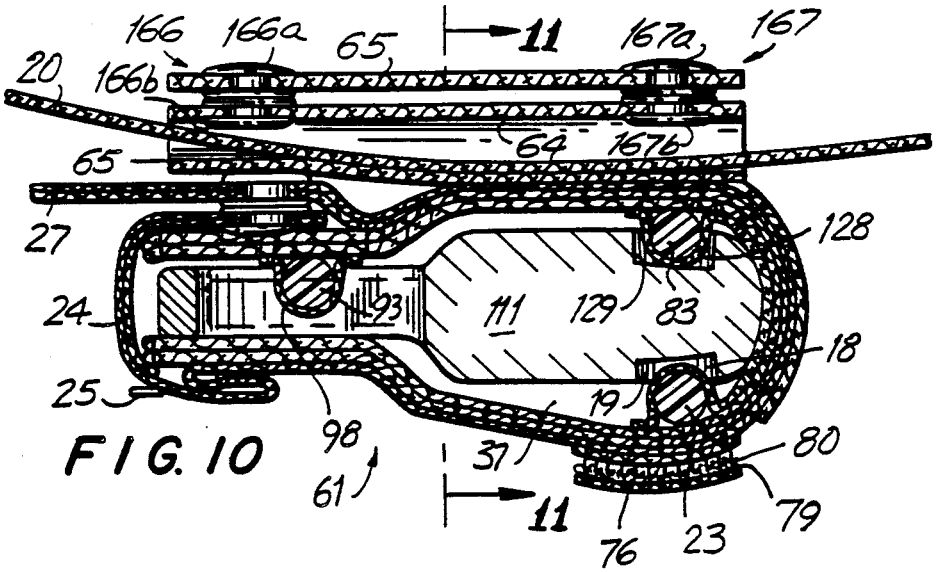
FIG. 10
FIG. 11
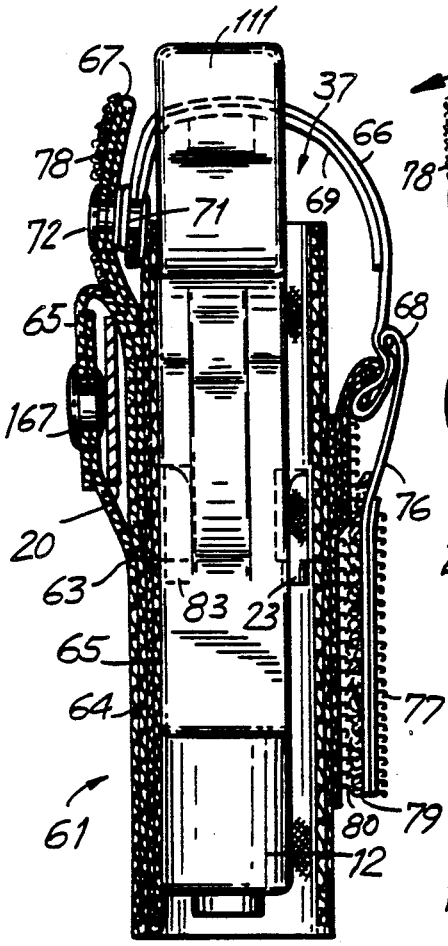
FIG. 12
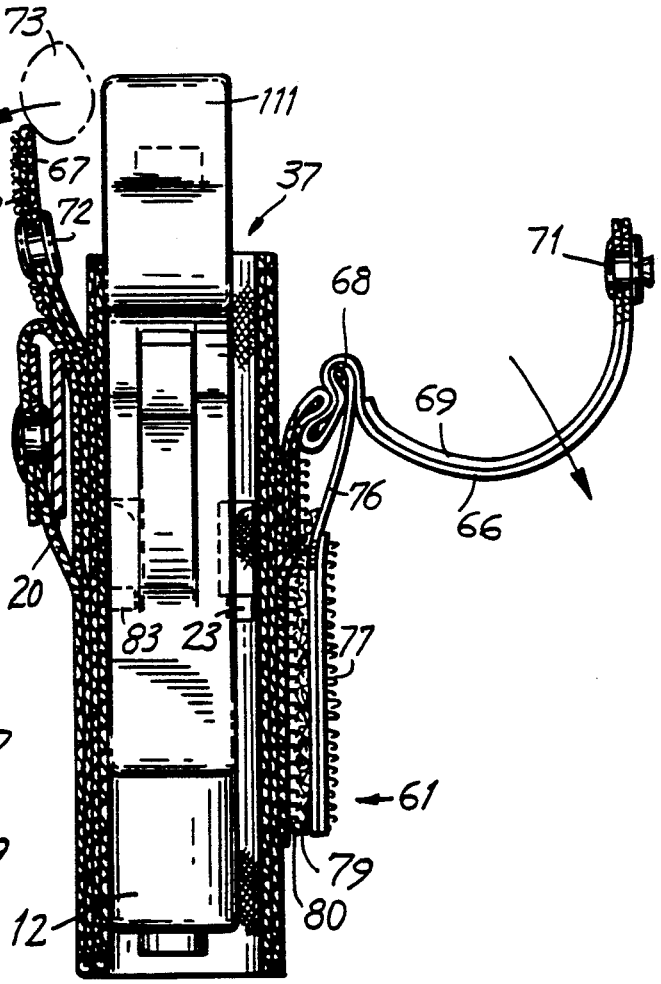

HOLSTER FOR AN AUTOMATIC WEAPON WITH INTERNAL RETENTION

BACKGROUND OF THE INVENTION

This invention relates to a holster for an automatic weapon and in particular, to a holster which retains the weapon securely and can be made of lightweight, durable and inexpensive materials.

Weapon holsters, which are well known in the art, are generally attached to a belt that is worn around the waist, leg, chest or elsewhere on the body. Typically, such holsters are in the shape of the weapon with an opening at the top for inserting and removing the weapon. Some holsters employ a restraining system wherein a releasable strap extends above the grip of the holstered weapon across the opening to secure the weapon in place.

The disadvantage of this single strap system is that the user's opponent has relatively easy access to the weapon merely by releasing the strap with one hand and removing the weapon by its grip with the other. Additionally, if the user is engaged in such physical activity as rolling or crawling, the strap may become undone and the weapon may accidentally slip out of the holster. The magnitude of the problem is exemplified in that 80% of police gunshot injuries and fatalities in the United States currently are inflicted to the officer by his or her own weapon.

Known weapon holsters designed to restrain the weapon more securely are made of leather with a releasable strap above the grip and another releasable strap across the trigger guard on the rearward side of the holster. This type of holster has an elaborate design, including a steel shank covered with leather which sits directly on top of the ejection port of an automatic weapon. To maintain the steel shank in its exact position, a steel member goes around the weapon to give the holster tension, and a steel screw is attached at the lower portion of the steel shank to apply pressure to the leather. To remove the weapon, both straps must be undone and the weapon must be removed in a backward, lifting motion. If only the upper strap is undone and the weapon is pulled straight up, the ejection port will be caught by the steel shank and the weapon cannot readily be removed from the holster.

The disadvantages of this holster are several. First, the holster is made of leather, which is subject to damage by water. It is also more expensive, heavier, and less durable than many man-made materials. Moreover, the elaborate steel shank design is complicated and expensive, and the leather in the region around the steel shank is subject to wear and not replaceable after it has worn away.

Lightweight and durable nylon holsters are also known in the art. Since nylon is lightweight and flexible, nylon holsters are unable to accommodate the complicated steel shank design utilized in the double-strap type leather holster. In order to provide the desirable feature of known stiff holsters, a nylon holster has been developed including a pocket on the inside of the holster which contains a plastic dowel. The plastic dowel secures the weapon by engaging the weapon above the muzzle end of the ejection port of the weapon. Although this structure is satisfactory, a holster structure which further helps to prevent accidental or unintentional removal of the weapon from the holster is desirable The nylon holster known in the art which contains a plastic dowel generally has a back keeper strap which is secured to an index finger break by snaps and which thereby urges the weapon forward so that the ejection port is engaged by the dowel. The snaps are disengaged to remove the weapon from the holster. When the holster is worn about the waist, the breaking apart of the snaps may be accomplished by the side of the user's index finger in a relatively rapid and fluid motion which does not impede the subsequent motion of removing the weapon. The back keeper strap and index finger break system is less than completely satisfactory, however, when the holster is worn against the leg. Since the user's hand approaches the back keeper strap and index finger break from above when the holster is worn against the leg instead of from behind as when the holster is worn against the waist, the motion to break apart the snaps is relatively awkward and hinders the removal of the weapon in a rapid, fluid motion. This delay may be life-threatening to the user of the weapon.

Accordingly, it is desirable to provide a weapon holster which can be fabricated of a lightweight, inexpensive, waterproof and durable material, yet which also prevents the weapon from being removed by accident or by an opponent. It is also desirable to provide such a weapon holster which can be worn against the leg and which may allow rapid removal by the user.

SUMMARY OF THE INVENTION

Generally speaking, in accordance with the invention, a holster for an automatic hand weapon with at least two internal restraining elements is provided. The holster may be made of lightweight, durable and inexpensive fabric materials which secures the weapon at the ejection port. A first pocket on the inside of the fabric piece contains a first dowel which secures the weapon by engaging the weapon above the muzzle end of the ejection port. A second pocket on the inside of the fabric piece contains a second dowel which secures the weapon by engaging the trigger guard of the weapon. At least one releasable strap is attached to the fabric piece to secure the weapon in the holster and urge the ejection port towards the first dowel. A third dowel may be located in a third pocket on the inside of the fabric piece in a position opposed to the first pocket and serves to urge the barrel of the weapon such that the ejection port of the weapon is more firmly secured against the first dowel.

Also provided is a holster which is suitable to be worn against a leg. The holster has an elastic strap situated across the partial rear opening of the holster. At least one pocket on the inside of the fabric piece contains a dowel which secures the weapon by engaging the weapon above the muzzle end of the ejection port The elastic strap secures the weapon in the holster and urges the ejection port towards the dowel, yet allows the user to rapidly remove the weapon without having to release a back snap.

Accordingly, it is an object of the invention to provide an improved holster for an automatic hand weapon.

Another object of the invention is to provide a holster for a hand weapon which prevents easy removal of the weapon by someone other than the user.

A further object of the invention is to provide a holster for a hand weapon which prevents accidental release of the weapon during strenuous physical activity by the user.

Still another object of the invention is to provide a holster for a hand weapon made of a lightweight synthetic material.

An additional object of the invention is to provide a holster for a hand weapon which may be worn against the leg and which will allow for rapid removal by the user.

Still a further object of the invention is to provide a holster for a hand weapon made of an inexpensive material.

Yet another object of the invention is to provide a holster for a hand weapon which is durable and waterproof.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is an illustration of a holster constructed and arranged in accordance with the invention as worn at the waist by a user with a weapon secured in place;

FIG. 2 is a cross-sectional view taken along line 2—2 of FIG. 1;

FIG. 4 is a partial cross-sectional view taken along line 4—4 of FIG. 3 showing the restraining of the first dowel when the weapon is seated in the holster;

FIG. 5 is a cross-sectional view as in FIG. 4, and illustrates the weapon being pulled in an upward direction impinging the first dowel;

FIG. 6 is a cross-sectional view as in FIGS. 4 and 5 with the weapon removed and illustrates the dowel partially removed from the pocket;

FIG. 7 is a plan view showing the inside of the holster fabric piece constructed and arranged in accordance with the preferred embodiment of the invention prior to assembly;

FIG. 8 is a plan view showing the outside of the holster fabric piece of FIG. 7;

FIG. 9 is an illustration of a holster constructed and arranged in accordance with the preferred embodiment of the invention as worn by a user at the waist with a weapon secured in place;

FIG. 10 is a cross-sectional view of the holster taken along line 10—10 of FIG. 9;

FIG. 11 is a cross-sectional view taken along line 11—11 of FIG. 10 when the weapon is seated in the holster with the primary upper strap fastened;

FIG. 12 is a cross-sectional view as in FIG. 11, and illustrates the unfastening of the primary upper strap;

DESCRIPTION OF THE PREFERRED EMBODIMENTS

A holster 21 constructed and arranged in accordance with a first embodiment of the invention for securing an automatic weapon 11 is illustrated in perspective in FIG. Holster 21 is fabricated from synthetic materials, such as a holster fabric piece of multilayer ballistic nylon with polypropylene reinforcing elements so that it is lightweight, formfitting, weather resistant, washable and maintenance free. Because safety of the wearer is important, particularly in police environments, holster 21 is designed to reduce or prevent automatic weapon 11 from being removed from holster 21 by a second person or accidentally during strenuous activity.

Figure 3:
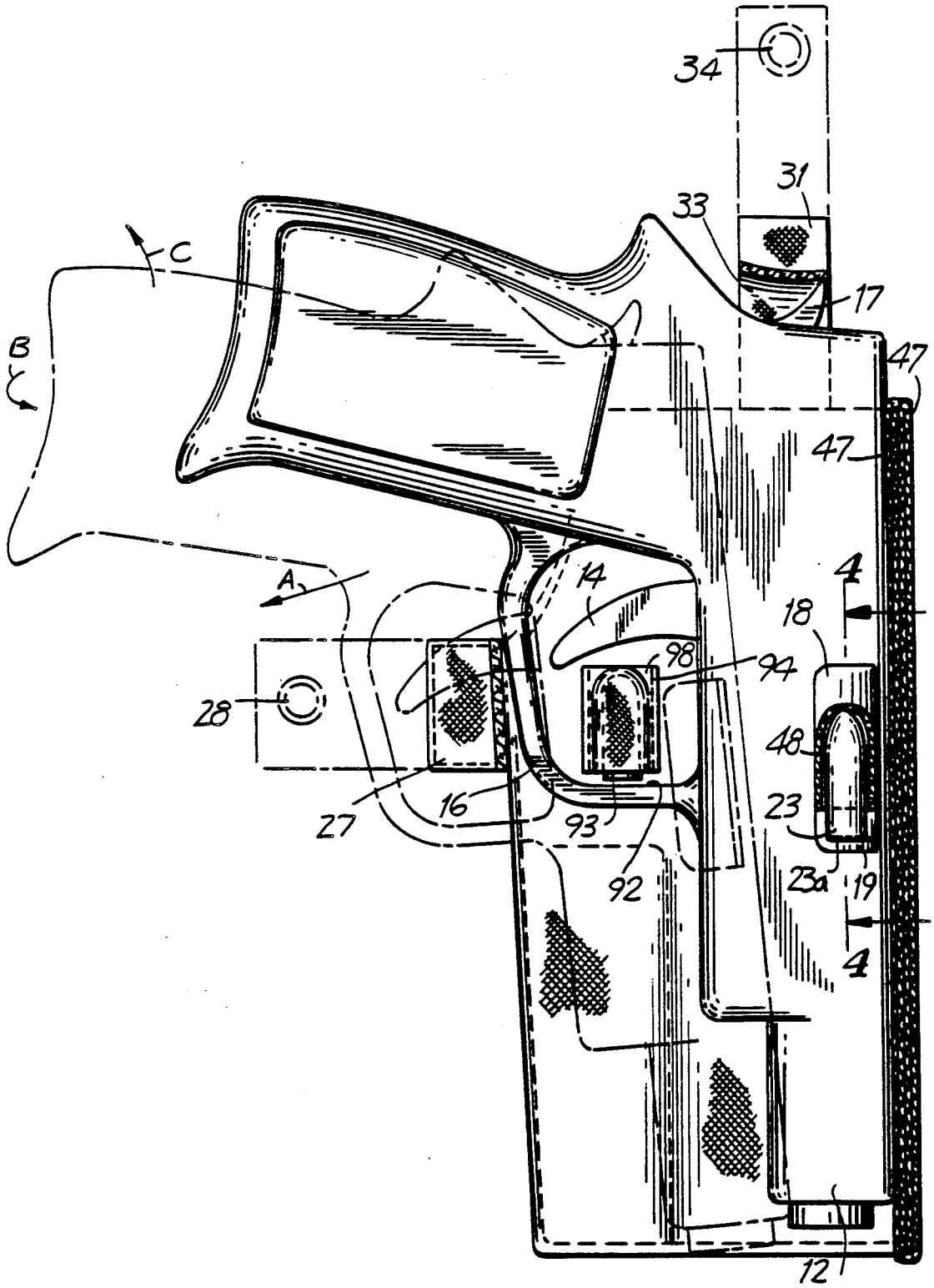
FIG. 3 is a cross-sectional view taken along line 3—3 of FIG. 2 and illustrates, in detail, the motion required to remove the weapon from the holster of FIG. 1.

Weapon 11 is an automatic hand weapon of the type illustrated in FIG. 3 and is formed with a barrel 12 mounted on a grip 3 with a trigger 14 protected by a trigger guard 16. Trigger guard 16 has a front portion 92 which is opposed to trigger 14. A hammer 17 is at the rear of barrel 12. An elongated ejection port 18 is located along the upper right side of barrel 12 and is formed with a front shoulder 19. Most automatic pistols presently on the market are formed with a similar ejection port as shown in weapon 11. Retention of weapon 11 in holster 21 is partially accomplished by securing a plastic dowel 23 on the interior surface of holster 21 above the muzzle end of ejection port 18 on the injector side of weapon 11.

The left side portion 79 of barrel 12 opposed to ejection port 18 is a continuous part of barrel 12 as depicted in FIG. 3. An additional dowel 83 secured on the interior surface of holster 21 serves to push barrel 12 more securely against dowel 23. Some automatic pistols are also formed with a second ejection port along left side portion 79 of barrel 12, as will be discussed in further detail below.

Retention of weapon 11 in holster 21 is also accomplished by securing a trigger guard plastic dowel 93 on the interior surface of holster 21 between trigger 14 and trigger guard 16. The combination of dowel 23 and trigger guard dowel 93, and optionally with second dowel 83, ensures maximum retention of weapon 11 in holster 21.

An adjustable and replaceable trigger keeper strap 24 is secured across the back of trigger guard 16 of weapon 11. Trigger keeper strap 24 is releasably secured to a trigger index finger break 27 which includes a male snap member 28 on trigger keeper strap 24 and a cooperating female snap portion 29 secured to index finger break 27. When keeper strap 24 is secured to index finger break 27, weapon 11 is forced forward against dowel 23, thus preventing weapon 22 from being lifted straight up or forward over dowel 23. In addition to this securing mechanism, a primary hammer keeper strap 33 is provided across hammer 17 and is releasably secured to a primary index finger break 31. As in the case of trigger 11, primary keeper strap 33 includes a male snap member 34 which cooperates with a female snap portion 36 mounted on primary thumb break 31.

Holster body 21 is formed from fabric piece 22 which is folded on itself to form a holster cavity 37 particularly well suited to accommodate and restrain a particular type of automatic weapon 11. Similarly, dowels 23, 83 and 93 are positioned to engage ejection port 18 and trigger guard 16 on weapon 11 when positioned within holster cavity 37. In the following description, dimensions are recited for a particular weapon, it being understood that the concepts applied herein are applicable to a wide variety of weapon sizes and shapes.

Holster body 21 in the embodiment illustrated in FIG. 1 is formed from a multi-layer piece of nylon ballistic fabric 22, commonly referred to as 1050 ballistic nylon by E. I. DuPont de Nemours & Co. As shown in FIGS. 7 and 8, a substantially square piece of ballistic nylon having a dimension approximately 7" wide and 6½" high. Holster 21 is multi-layered and has an interior fabric piece 41 and a mating outer fabric piece 42. In the embodiments illustrated in FIGS. 1 and 9, interior fabric 41 and exterior fabric 42 are a single ply with mating upper cut out sections 43. Either one or both pieces of the fabric may be single or multi-layered.

During fabrication, interior fabric 41 and outer fabric 42 are laid up together, stitched along the perimeter and turned inside out with a stitch line 44 to enclose the edge fully. The fabric pieces are then quilt stitched at approximately 1" spaces along quilt stitching lines 46. Trigger keeper strap 24 and trigger index finger break 27 of a polypropylene tape are secured into position running horizontally along outer fabric 42. Keeper strap 24 is adjustably mounted to outer fabric 42 by a first buckle 25. Similarly, primary thumb break 31 and primary keeper strap 34 are positioned vertically above the trigger keeper strap 24 and secured to the composite fabric of holster body 21 by stitching. In all cases fabric and tapes are cut by a hot blade to prevent any unravelling of the woven yarns.

At this point, composite fabric 22 of holster body 21 possesses structural integrity from the multi-layer thickness and the additional stitched straps. In order that the completed holster maintains its shape, a stiffening tape 47 is laid down running vertically substantially through the mid-point of composite fabric piece 22 with at least a single layer thickness running across inner fabric 41 and outer fabric 42 along what will be a fold line between two halves of holster 21. In a preferred embodiment two thicknesses of stiffener tape 47 are secured on inner surface 41 of holster fabric 22 and one is on outer surface 42.

A dowel pocket 48 is positioned to one side of stiffener tape 47 on inside fabric 41 of composite fabric 22. A second dowel pocket 88 may be positioned on the other side of stiffener tape 47 on inside fabric 41 of composite fabric 22. As noted above, the specific location of dowel pockets 48 and 88 will depend on the particular model of weapon 11 for which holster body 21 is being fabricated. Dowel pocket 48 is positioned to the right side of stiffener tape 47 somewhat above the mid-point of the height of holster fabric 22 as shown in FIG. 7, with dowel pocket 88 on the opposing side. Dowel pockets 48 and 88 are stitched with stitches 49 and 84 running both vertical sides and horizontally across the top of dowel pockets 48 and 88 with a downwardly facing opening.

A trigger guard dowel pocket 98 is positioned adjacent to an edge on inside fabric 41 of composite fabric 22 and stitched with stitching 94. The exact location of trigger guard dowel pocket 98 will depend on the particular model of weapon 11 for which holster body 21 is being fabricated. Trigger guard dowel pocket 98 may be positioned adjacent either edge of inside fabric 41. However, for reasons detailed below, the preferred edge is the one which is worn closest to the user's body such that trigger guard dowel pocket 98 is on the portion of inside fabric 41 adjacent the user's body.

A releasable belt holder 51 is secured to holster fabric 22 at the side of trigger index finger break 27. In this case, this is the right side of outer fabric 42 to secure holster body 21 to the right side of a wearer's duty belt 20. Belt holder 51 is secured by stitching through composite fabric 45 and includes an openable and closeable Velcro section or a snap assembly 55 for securing holster body 21 about belt 20 to be worn by a user.

During assembly of holster body 21, outside ends are folded over and secured by stitching 53 running vertically and substantially parallel to weapon barrel 12 and below trigger guard 26. Holster fabric 22 is folded about both edges of stiffener tape 47 which then forms the front of holster 21. After completion of stitching 53, holster body 21 is sufficiently stiff to maintain its configuration to receive weapon 22.

Referring specifically to FIG. 3, weapon 11 is shown engaged within holster body 21. Weapon 22 is typical of automatic pistols presently available having ejection port 18 adjacent to the upper right side portion thereof. Ejection port 18 is an elongated depression in the side of weapon 11 and includes a front shoulder 19. As noted above, when weapon 11 is engaged in holster body 21, dowel 23 formed with a flat lower end **23*a* is seated immediately above and overlapping front shoulder 19 of ejection port 18. The overlap between flat end 23*a* of dowel 23 and front shoulder 19 of ejection port 18 is shown in the cross-section in FIG. 2. Dowel 23 is approximately ¼" in diameter by about ⅝" to ¾ in length and can be formed of a rigid plastic, wood or metal. Dowel 23 is formed with a tapered upper end 23*b* to facilitate snug insertion into dowel pocket 48 during assembly. The exact size of dowel 23 depends on the particular weapon for which holster body 21 has been fabricated FIGS. 4 and 5 further illustrate how dowel 23 engaged ejection port 18 to prevent weapon 11 from being removed in a straight upwardly direction. In FIG. 4, weapon 11 is stationary and shown in a fully at rest position within holster 21. Weapon 11 is shown as it is being lifted straight upwardly without the required rearward motion so that shoulder 19 of ejection port 18 engages flat front edge 23*a* of dowel 23 preventing weapon 11 from being removed from holster 21. In the preferred embodiments when weapon 11 is secured in holster 21, the distance maintained between dowel 23 and shoulder 19 of ejection port 18** is between about ⅜" to ½". The specific distance therebetween will depend upon the particular weapon.

In all constructions, the distance between front shoulder 19 and flat end **23*a* of dowel 23 is important. If the distance is too great, dowel 23 will fail to engage front shoulder 19. If the distance is too small, it will be more difficult to remove weapon 11** intentionally even when all the external securing devices are released.

Trigger guard dowel 93 is similar to dowel 23 and interacts with front portion 92 of trigger guard 16 in much the same manner that dowel 23 interacts with front shoulder 19 of ejection port 18. Trigger guard dowel 93 and pocket 98 are sized and positioned to be between trigger 14 and trigger guard 16 such that trigger 14 does not contact trigger guard dowel 93 and pocket 98 even when weapon 11 is positioned as far as possible into holster 21. The distance between front portion 92 of trigger guard 16 and trigger guard dowel 93 must likewise be large enough to permit the removal of weapon 11 from holster 21 when twisted properly, but yet must be small enough so that trigger guard dowel 93 engages trigger guard 16.

The exact location of second dowel 83, if present, is less critical than the positions of dowel 23 and trigger guard dowel 93 Any position where second dowel 83 serves to push barrel 12 against dowel 23 is adequate.

The appropriate way to remove weapon 11 from holster 21 is shown in FIG. 3. The solid line showing of weapon 11 is in the secured position. With the external securing devices released, weapon 11 is initially displaced in a natural rearward direction as shown in phantom by arrow A. At the same time, weapon 11 is twisted slightly as shown in phantom by arrow B. Weapon 11 is then removed upwardly in the direction shown by an arrow C. The initial natural rearward direction separates shoulder 19 from a position where it can be engaged by flat end 23*a* of dowel 23. The twisting motion releases weapon 11 from a position where trigger guard 16 is engaged by trigger guard dowel 93. The twisting motion is in the direction away from trigger guard dowel 93. Since the twisting motion is easier to accomplish in a direction away from instead of towards the body, trigger guard dowel 93 is preferably located on the side of inside fabric 41 which is closest to the user's body.

FIGS. 9–12 illustrate a holster 61 for an automatic hand weapon 111 constructed in accordance with another embodiment of the invention. Weapon 111 is similar to weapon 11 except the left side portion 79 of barrel 12 opposed to ejection port 18 is not a continuous part of barrel 12, but instead possesses a second elongated ejection port 128 with a front shoulder 129. Dowel 83 cooperates with second ejection port 128 and front shoulder 129 in a manner similar to the interaction between dowel 23, ejection port 18 and front shoulder 19.

Holster 61 is formed from the same composite fabric 22 utilized in holster 21, but has an improved primary keeper strap 66 designed to remain free of holster cavity 37 when weapon 11 is released. Holster 61 is formed from fabric piece 22 shown in FIGS 7 and 8 with some additional stitched fabric elements.

A back rear flap 64 and a front rear flap 65 are attached to outer fabric 42 of holster 61 by stitching 63. Back rear flap 64 extends upwards from the muzzle end of holster 61 and extends beyond where stitching 63 ends. At the muzzle end of holster 61, front rear flap 65 is sandwiched between back rear flap 64 and outer fabric 42. However, front rear flap 65 is also stitched to fabric 22 beyond where stitching 63 ends, and then extends outward from holster 61 and around the unstitched portion of back rear flap 64. Back rear flap 64 and front rear flap 65 are then joined by snap members 166 and 167 with stud sides 166*a* and 167*a* attached to back rear flap 64 and, socket sides 166*b* and 167*b* attached to front rear flap 65. When snap members 166 and 167 are engaged, belt 20 may be enclosed above stitching 63 between the unstitched portion of back rear flap 64 and the portion of front rear flap 65 stitched to holster 61.

Weapon 111 is retained in holster 61 by a hinged primary keeper strap 66 disposed across hammer 17 and is releasably coupled to a primary thumb break 67. Primary keeper strap 66 in this preferred embodiment passes through a second buckle 68 and has a stiffening tape 69 attached to the inner surface above second buckle 68. Stiffening strip 69 may be of the polypropylene material utilized for stiffening tape 47. Alternatively, stiffening tape 69 may be entirely enclosed by a third strip made of the same material as primary keeper strip 66 which is then stitched to keeper strap 66. Primary keeper strip 66 has male break snap element 71 for cooperating with a female break snap element 72 on thumb break 67.

As shown in FIG. 12, when a thumb 73 disengages thumb break snap elements 71 and 72, strap 66 falls away from holster 61 because of the weight of strap 66 due to the presence of stiffening tape 69. This allows sure and quick access to weapon 111. To facilitate this action, stiffening strip 69 must not extend beyond that portion of strap 66 directly above second buckle 68 or whatever direct or indirect means is used to attach strap 66 to holster fabric piece 22. This region of keeper strap 66 above buckle 68 functions as a hinge which keeps strap 66 away from thumb break 67 when opened.

Holster 61 may also have a third releasable upper safety strap 76. As shown in FIGS. 9–12, safety strap 76 is attached to fabric 22 and extends through second buckle 68. A first inner Velcro portion 77 is stitched to safety strap 76 with a cooperating Velcro loop tape 78 which is attached to thumb break 67 opposite the side where first outer Velcro tape 77 is attached. Second inner Velcro hook tape 80 is stitched to fabric 22 directly under buckle 68. When safety strap 76 is extended over primary keeper strap 66 and thumb break 67, Velcro tape 77 on strap 76 engages first Velcro loop tape 78 on thumb break 67, thereby further securing weapon 11 in holster 61. Safety strap 76 may be stored in an away position when second Velcro loop tape 79 on strap 76 is engaged by second Velcro hook tape 80.

The remainder of holster 61 is identical to holster 21 as described earlier. Dowels 23, 83 and 93 are positioned at the same locations on the interior, and trigger keeper and trigger index finger break remain the same as in the earlier embodiment. The advantages of holster 61 constructed in accordance of this embodiment of the invention is the hinge action of primary keeper strap 66 keeps it out of the path of weapon 11 as it is removed from holster 61 due to the hinging action of primary keeper strap 66.

Holster 21 and 61 are made of synthetic materials which have many advantages over leather. Specifically, leather is more expensive, heavier, and less durable. Unlike leather, synthetic materials are waterproof and will not be ruined by exposure to salt water. Thus, the weapon holster according to the invention will be particularly suited to use in outdoor conditions, particularly for SWAT teams and coastal patrols.

Holster composite fabric 22, dowel pockets 48, 88 and 98 and the assorted straps may be made of any synthetic material which is waterproof. It is anticipated that polymers such as polyamides will be preferred as materials. Particularly, preferred polyamides include Ballistic Nylon and Kodura Pack Cloth.

Dowels 23, 83 and 93 may be made of a variety of materials, for example, any rigid plastic, wood or steel. Nevertheless, plastic is particularly preferred because of its inexpensive and lightweight nature.

The weapon holster may be attached to a belt which is worn around the waist, chest, or other part of the body. In FIGS. 1 and 7, the holsters are attached to belt 20 which is worn around the waist. The holsters constructed in accordance with the invention are particularly suited for attachment to a waist belt since the weapon holster is especially designed to deter the upward motion of an assailant grabbing the weapon at waist level.

The operation of a holster constructed and engaged in accordance with the invention is as follows. The user first releases the safety strap, if present and engaged. He then simultaneously uses his thumb to disengage the hammer snap and the side of his index finger to disengage the trigger snap. This movement can be accomplished in the same fluid motion as the hand is closing around the handle of the weapon. The weapon is then removed in a backwards, twisting and lifting motion which becomes automatic with minimal practice by the user.

For an assailant to remove the weapon, however, he must first release the safety strap, if present and positioned. He must then disengage the trigger and hammer snaps, which is difficult if not impossible to accomplish from a non-user position with only one hand. The assailant must then remove the weapon in a backwards, twisting and lifting motion. If the assailant releases only one strap or lifts the weapon straight up or without twisting, the gun will not be released from the holster due to the engagement of the ejection port and trigger guard by the dowels.

Similarly, if the user is engaged in such physical activity as rolling or crawling, the likelihood of all straps becoming undone and the weapon moving in the exact backwards, twisting and lifting direction is much smaller than in a single-strap weapon holster that does not have the pocket and dowel configuration, or even in a holster that has only a single pocket and dowel configuration.

Figure 14:
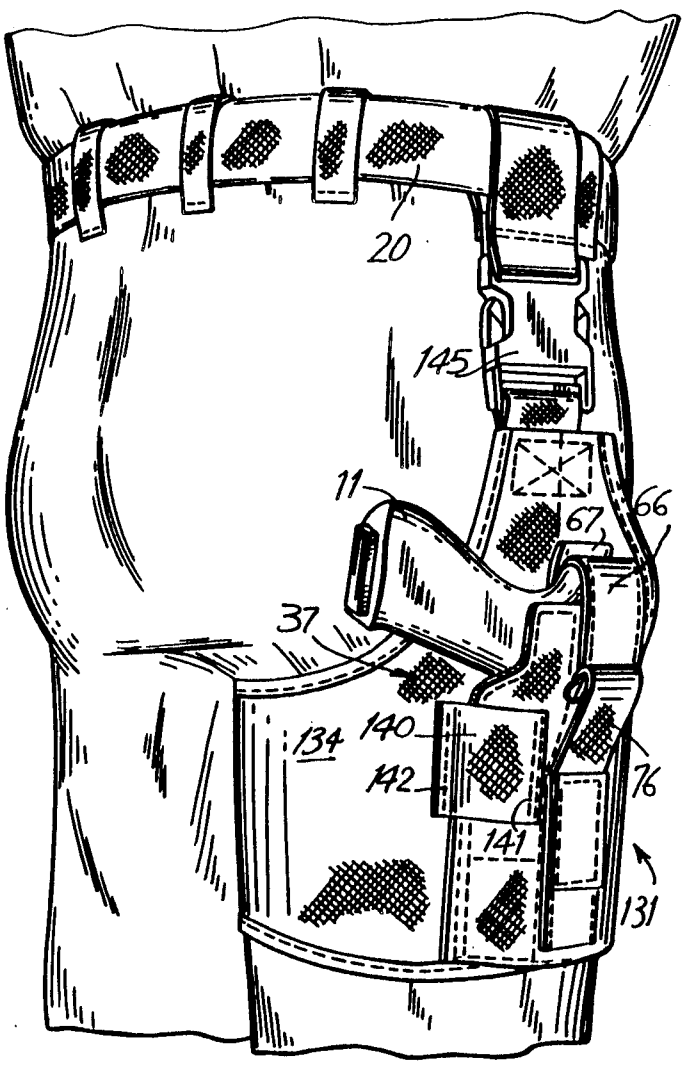
FIG. 14 is a back-angle of the same illustration as FIG. 13.
Figure 13:
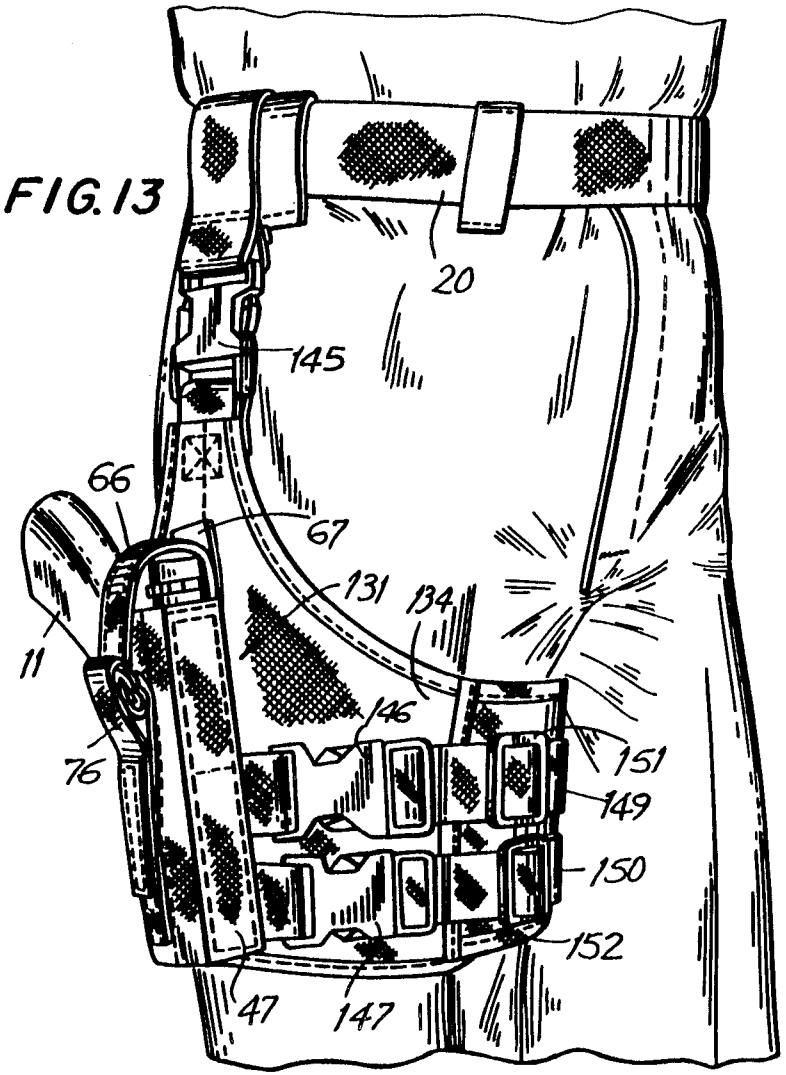
FIG. 13 is a front-angle illustration of a holster constructed and arranged in accordance with the invention as worn against the leg by a user with a weapon secured in place.

FIGS. 13 and 14 illustrate a holster 131 for an automatic hand weapon 11 constructed in accordance with a third embodiment of the invention. Holster 131 is particularly adapted to be worn against a leg. Holster 131 is stitched to a leg sash 134 which in turn is releasably secured to belt 20 with a first clasp 145. Leg sash 134 is also wrapped around and releasably secured to a leg with second and third clasps 146 and 147 with adjustments to the width of the individual leg effected by the use of adjusting straps 149 and 150 adjusting buckles 151 and 152. Leg sash 134 may be made of a lightweight fabric, and clasps 145–147 and buckles 151 and 152 may be made of a lightweight plastic. Leg sashes such as leg sash 134 illustrated in FIGS. 13 and 14 are known in the art, and so the invention is not limited to the particular sash illustrated herein.

Holster 131 is similar to holster 61, including hinged primary keeper strap 66 releasably coupled to a primary thumb break 67 and third releasable upper safety strap 76. However, in place of trigger keeper strap 24, trigger index finger break 27 and their corresponding snap members 28 and 29, an elastic strap 140 extends across the back portion of holster cavity 37 which corresponds to the location of trigger guard 16 of weapon 11.

Elastic strap 140 is sewn directly on holster 131 with stitching 141 and on leg sash 134 with stitching 142. Elastic strap 140 is made of an elastic material which has sufficient strength to force the ejection port of weapon 11 against the ejection port dowel, yet which may be stretched with pressure from weapon 11 by the user to allow weapon 11 to be withdrawn from holster 131. In the embodiment illustrated, elastic strap 140 has a height of approximately 2 inches, although this length may vary depending on the particularly make and model of weapon used.

For holsters intended to be worn against the leg, elastic strap 140 is preferable over the snaps and straps system shown in FIGS. 1–12 because the side of the user's index finger has more difficulty releasing the snaps if the holster is worn against the leg instead of the waist. Elastic strap 140 secures weapon 11 in holster 131 yet allows weapon 11 to be withdrawn quickly when needed, whether a single or multiple dowel system is utilized in holster 131.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A holster for an automatic hand weapon, having an elongated ejection port with a flat shoulder at the forward end thereof and a trigger guard surrounding a trigger with a substantially flat inner surface at the forward end opposed to the trigger, comprising;

a fabric piece of a synthetic material folded on itself along a fold line to form the holster with the fold line in the front and the edges of the fabric piece aligned along the rear to form an interior cavity substantially corresponding to the shape of the weapon with a primary upper opening for inserting the weapon into the cavity, and stiffening tape means disposed along the fold line of the fabric piece for defining the front of the holster;

stitch means disposed along a portion of the rear mating edges of the fabric piece for permanently closing the fabric piece;

a first pocket attached to the inside of the fabric piece adjacent to the fold line and positioned to engage the ejection port of a weapon in the cavity;

a first substantially rigid dowel having a substantially flat bottom positioned in the first pocket, whereby when a weapon is inserted into the holster cavity, the flat bottom of the first dowel overlaps the shoulder of the ejection port of the weapon to prevent withdrawal of the weapon in a substantially upward direction;

a second pocket attached to the inside of the fabric piece adjacent to an edge and positioned to cooperate with the trigger guard on the weapon;

a second substantially rigid dowel having a substantially flat bottom positioned in the second pocket, whereby when the weapon is inserted into the holster cavity, the flat bottom of the second dowel overlaps the substantially flat inner surface of the trigger guard to prevent withdrawal of the weapon in a substantially upward direction; and at least one releasable strap means for securing the weapon in the holster and urging the weapon toward the dowels when secured, thereby preventing unintentional withdrawal of the weapon from the holster.

2. The holster of claim 1, wherein the at least one releasable strap means is a primary keeper strap extending over the hammer portion of the weapon and further including a second releasable trigger keeper strap extending across the trigger guard of the weapon for urging the weapon forward in the holster towards the first dowel.

3. The holster of claim 1, wherein the releasable strap means is a hinged primary keeper strap mounted to the outside of the holster body extending away from the users body when in an open position and extending over the hammer portion of the weapon when in a closed position, the keeper strap being weighted in the portion away from the mounting to the holster so that when in the open position the keeper strap remains away from the path of removal of the weapon from the holster.

4. The holster of claim 1, further comprising:

a third pocket attached to the inside of the fabric piece adjacent to the fold line in a position opposed to the first pocket;

a third substantially rigid dowel positioned in the third pocket, whereby when the weapon is inserted into the holster cavity, the presence of the dowel pushes the barrel of the weapon at a position opposite to the ejection port such that the ejection port is more firmly secured against the first dowel.

5. A holster, suitable for being worn against a leg, for an automatic hand weapon, having an elongated ejection port with a flat shoulder at the forward end thereof, comprising:

a fabric piece of a synthetic material folded on itself along a fold line to form the holster with the fold line in the front and the edges of the fabric piece aligned along the rear to form an interior cavity substantially corresponding to the shape of the weapon with a primary upper opening which extends to a partial rear opening for inserting the weapon into the cavity, and stiffening tape means disposed along the fold line of the fabric piece for defining the front of the holster;

stitch means disposed along a portion of the rear mating edges of the fabric piece, up to the partial rear opening for permanently closing the fabric piece;

a pocket attached to the inside of the fabric piece adjacent to the fold line and positioned to engage the ejection port of a weapon in the cavity;

a substantially rigid dowel having a substantially flat bottom positioned in the pocket, whereby when a weapon is inserted into the holster cavity, the flat bottom of the dowel overlaps the shoulder of he ejection port of the weapon to prevent withdrawal of the weapon in a substantially upward direction; and an elastic strap means extending across at least a portion of the partial rear opening for securing the weapon in the holster and urging the weapon toward the dowel, thereby preventing unintentional withdrawal of the weapon from the holster.

* * * * *